US009739459B2

(12) United States Patent
Helbig et al.

(10) Patent No.: US 9,739,459 B2
(45) Date of Patent: Aug. 22, 2017

(54) ILLUMINATION DEVICE

(71) Applicant: OSRAM GmbH, Munich (DE)

(72) Inventors: Philipp Helbig, Heidenheim (DE); Stephan Schwaiger, Ulm (DE)

(73) Assignee: OSRAM GmbH, Munich (DE)

( * ) Notice: Subject to any disclaimer, the term of this patent is extended or adjusted under 35 U.S.C. 154(b) by 176 days.

(21) Appl. No.: 14/390,042

(22) PCT Filed: Apr. 12, 2013

(86) PCT No.: PCT/EP2013/057723

§ 371 (c)(1),
(2) Date: Oct. 2, 2014

(87) PCT Pub. No.: WO2013/156411

PCT Pub. Date: Oct. 24, 2013

(65) Prior Publication Data

US 2015/0077988 A1 Mar. 19, 2015

(30) Foreign Application Priority Data

Apr. 17, 2012 (DE) ..... 10 2012 206 332

(51) Int. Cl.

| | |
|---|---|
| ***F21V 17/16*** | (2006.01) |
| ***F21V 19/00*** | (2006.01) |
| *F21V 17/12* | (2006.01) |
| *F21V 29/89* | (2015.01) |
| *F21Y 115/10* | (2016.01) |

(52) U.S. Cl.

CPC ..... *F21V 19/004* (2013.01); *F21V 17/16* (2013.01); *F21V 19/005* (2013.01); *F21V 19/0035* (2013.01); *F21V 19/0055* (2013.01); *F21V 17/12* (2013.01); *F21V 29/89* (2015.01); *F21Y 2115/10* (2016.08)

(58) Field of Classification Search

CPC .... F21V 19/004; F21V 19/0035; F21V 17/16; H01L 24/72

See application file for complete search history.

(56) References Cited

U.S. PATENT DOCUMENTS 8,444,308 B2 * 5/2013 Matsunaga ..... F21K 9/00 362/373
2004/0240229 A1 12/2004 Blumel et al.
(Continued)

FOREIGN PATENT DOCUMENTS

CN 101175943 A 5/2008
CN 102714266 A 10/2012
(Continued)

OTHER PUBLICATIONS

Abstract—DE102009052340, dated May 5, 2011.
(Continued)

*Primary Examiner* — Robert May
*Assistant Examiner* — Leah S Macchiarolo
(74) *Attorney, Agent, or Firm* — Viering, Jentschura & Partner mbB

(57) ABSTRACT

Various embodiments may relate to an illumination device including at least one semiconductor light source arrangement that is fixed to a carrier. The at least one semiconductor light source arrangement is fixed to the carrier at multiple locations by means of a press fit.

9 Claims, 6 Drawing Sheets

(56) References Cited

U.S. PATENT DOCUMENTS

| | | | | |
|---|---|---|---|---|
| 2008/0087911 | A1 | 4/2008 | Stoyan | |
| 2008/0135865 | A1 | 6/2008 | Stoyan et al. | |
| 2008/0151547 | A1 | 6/2008 | Grotsch et al. | |
| 2009/0207617 | A1* | 8/2009 | Merchant | F21K 9/00 362/294 |
| 2012/0273812 | A1 | 11/2012 | Takahashi et al. | |
| 2013/0010455 | A1 | 1/2013 | Sakamoto et al. | |
| 2013/0077324 | A1* | 3/2013 | Schroll | F21V 19/002 362/382 |
| 2013/0121759 | A1 | 5/2013 | Breidenassel et al. | |
| 2014/0179139 | A1* | 6/2014 | Tanaka | F21V 19/003 439/226 |

FOREIGN PATENT DOCUMENTS

| | | | |
|---|---|---|---|
| DE | 10133255 | A1 | 1/2003 |
| DE | 102006048230 | A1 | 4/2008 |
| DE | 202006017583 | U1 | 4/2008 |
| DE | 202009011689 | U1 | 1/2010 |
| DE | 102009052340 | A1 | 5/2011 |
| DE | 102010031312 | A1 | 1/2012 |
| DE | 102010039120 | A1 | 2/2012 |
| DE | 102011102550 | A1 | 5/2012 |
| DE | 202012101344 | U1 | 8/2012 |
| JP | 2009080991 | A | 4/2009 |
| JP | 4811377 | B2 | 11/2011 |
| WO | 2006097067 | A1 | 9/2006 |
| WO | 2008065030 | A1 | 6/2008 |
| WO | 2012065869 | A1 | 5/2012 |

OTHER PUBLICATIONS

Abstract—DE102010039120, dated Feb. 16, 2012.

International Search Report PCT/EP2013/057723 dated Jun. 24, 2013.

Chinese Office Action based on application No. 201380020638.5 (5 pages and 8 pages of English translation) dated Nov. 28, 2016 (Reference Purpose Only).

* cited by examiner

ILLUMINATION DEVICE

RELATED APPLICATIONS

The present application is a national stage entry according to 35 U.S.C. §371 of PCT application No. PCT/EP2013/057723 filed on Apr. 12, 2013, which claims priority from German application No. 10 2012 206 332.3 filed on Apr. 17, 2012, and is incorporated herein by reference in its entirety.

TECHNICAL FIELD

Various embodiments generally relate to an illumination.

BACKGROUND

An illumination device of this type is disclosed by way of example in WO 2008/065030 A1. This unexamined German application describes an illumination device having a semiconductor light source arrangement that is fixed by means of adhesive material to a carrier that is embodied as a heat sink.

SUMMARY

Various embodiments provide an illumination device of the generic type wherein the manner in which the semiconductor light source arrangement is fixed to a carrier is improved.

The illumination device in accordance with the disclosure includes at least one semiconductor light source arrangement that is fixed to a carrier at multiple locations by means of a press fit.

The term "press fit" in this case describes a relationship between two fastening elements of the at least one semiconductor light source arrangement and the carrier and said fastening elements are coordinated with one another, wherein the first fastening element is a hole and the second fastening element is a rod-type fastening element that is arranged in the hole, said rod-type fastening element being by way of example a connecting lug, a pin, a rivet, a screw or the like and wherein, at least in a spatial direction, the dimensions of the hole are smaller than the corresponding dimensions of the rod-type fastening element so that the rod-type fastening element is arranged in the hole with a force fit or a press fit. Among people skilled in the art, the press fit is also described as an interference fit. By way of example, the first fastening element of the press fit, in other words the hole, is arranged in a holding device part of the at least one semiconductor light source arrangement and the second, rod-type fastening element is arranged on the carrier. However, this may also be reversed. In other words, the first fastening element of the press fit, namely the hole, may be arranged in the carrier and the second, rod-type fastening element may be arranged on a holding device part of the at least one semiconductor light source arrangement. As a further alternative, holes may be arranged in both the carrier and also in the at least one semiconductor light source arrangement, wherein the holes in the carrier and in the at least one semiconductor light source arrangement correspond to one another so that a rod-type fastening element may be inserted into both a hole of the carrier as well as into a hole of the at least one semiconductor light source arrangement and said rod-type fastening element is arranged with a force fit or a press fit in the hole of the carrier and in the hole in the semiconductor light source arrangement that corresponds to said hole in the carrier in order to fix the carrier and semiconductor light source arrangement to one another with the aid of the rod-type fastening element.

It is possible to precisely position and align the at least one semiconductor light source arrangement on the carrier as a result of fixing the at least one semiconductor light source arrangement to the carrier at multiple locations by means of a press fit. In particular, it is possible to compensate for tolerances in the case of the dimensions for the at least one semiconductor light source arrangement and the carrier by means of the mechanical stress of the press fit, and it is possible to ensure that the at least one semiconductor light source arrangement is fastened to the carrier in a play-free manner. In addition, the press fit renders possible a good thermal coupling between the at least one semiconductor light source arrangement and its carrier.

The at least one semiconductor light source arrangement is advantageously fixed to the carrier at at least three locations in each case by means of a press fit. As a consequence, it is ensured that the at least one semiconductor light source arrangement is fastened to the carrier in a play-free manner in the desired position and alignment.

The press fits are advantageously embodied as clamp-type holding devices on at least two of the three above mentioned locations on the carrier. As a consequence, the effects of different thermal expansion coefficients of the at least one semiconductor light source arrangement and the carrier are compensated for in relation to the relative position and alignment of semiconductor light source arrangement and carrier, and an arrangement of semiconductor light source arrangement and carrier is also ensured in the operating state, in other words in the greatly heated state of the semiconductor light source arrangement, said arrangement being free from play. The mechanical stresses that occur in the case of a different thermal expansion of the semiconductor light source arrangement and the carrier and that act upon the semiconductor light source arrangement are absorbed by the clamp-type holding devices. In addition, the clamp-type holding devices also compensate for the mechanical stresses that are caused as a result of an imprecise alignment of the fastening elements of the press fit that are arranged on the semiconductor light source arrangement in relation to the fastening elements of the press fit that are arranged on the carrier.

The press-fit arrangements are advantageously formed by holes in a holding device part of the at least one semiconductor light source arrangement and by rod-type fastening elements that are arranged in the holes and are fixed on the carrier or in the carrier. As a consequence, the rod-type fastening elements may be used additionally for the purpose of fixing an optical device to the carrier and said optical device is arranged downstream of the at least one semiconductor light source arrangement. Fastening elements from the group of connecting lug, pin, rivet and screw or the like are used as rod-type fastening elements. The rod-type fastening elements are preferably embodied from metal for the purpose of including good heat conducting characteristics and are preferably in each case arranged in a bore hole of the carrier. As a consequence, it is possible to precisely position and align the at least one semiconductor light source arrangement on the carrier since bore holes may be embodied with a high degree of precision. The bore holes in the carrier may therefore be used as reference for the alignment and assembly of the at least one semiconductor light source arrangement and also where necessary for an additional optical device on the carrier.

The above-mentioned holding device part of the at least one semiconductor light source arrangement is preferably embodied from synthetic material. As a consequence, the semiconductor light sources of the at least one semiconductor light source arrangement may be provided with a housing or a holding frame for further assembly on a heat sink in a simple manner by means of injection molding methods.

The clamp-type holding devices are in each case formed by the holding device part and by a hole in the holding device part, said hole extending as far as an outer edge of the holding device part, and also by a rod-type fastening element that is arranged in said hole and is fixed in the carrier or on the carrier. As a consequence, a clamping effect is achieved in a simple manner. In other words, the rod-type fastening element that is arranged in the hole is held in the hole as if it is clamped therein. In particular, the holding device part clamps the at least one semiconductor light source arrangement to the rod-type fastening element that by way of example is pressed into the carrier or is embodied as a component part of the carrier.

The illumination device in accordance with various embodiments includes at least one optical device that is arranged downstream of the at least one semiconductor light source arrangement so that light that is emitted by the at least one semiconductor light source arrangement impinges upon the at least one optical device. This optical device is preferably fixed to the carrier at the same locations as the at least one semiconductor light source arrangement by means of a press fit. As a consequence, the system efficiency is increased because a common press fit for the at least one semiconductor light source arrangement and the at least one optical device is used for the purpose of fixing said parts to the carrier and as a consequence, no additional tolerance for the position and alignment of the at least one optical device is caused while fastening said parts to the carrier.

The at least one optical device advantageously includes a base section that is provided with holes for the press fits, wherein at least some of the holes in the base section of the at least one optical device correspond to the holes in the holding device part of the at least one semiconductor light source arrangement. As a result of arranging the holes in a base section of the at least one optical device it is ensured that the holes do not influence the optical characteristics of the at least one optical device. Since at least some of the holes in the base section of the at least one optical device correspond to the holes in the holding device part of the at least one semiconductor light source arrangement, the at least one optical device and the at least one semiconductor light source arrangement may be fixed to the carrier at the locations of these holes by means of a common press fit.

The base section of the at least one optical device preferably includes at least two clamp-type holding device elements that in each case are formed by the base section and by a hole that extends to an outer edge of the base section. As a consequence, the effects of different thermal expansion coefficients of the at least one optical device, the at least one semiconductor light source arrangement and the carrier are compensated for in relation to the relative position and alignment of the optical device, the semiconductor light source arrangement and the carrier and a play-free arrangement of the optical device, the semiconductor light source arrangement and the carrier is also ensured in the operating state of the semiconductor light source arrangement. The mechanical stresses that act upon the optical device and occur during a different thermal expansion of the optical device, the semiconductor light source arrangement and the carrier are absorbed by the clamp-type holding device elements. In addition, the clamp-type holding device elements also compensate for the mechanical stresses that are caused as result of an imprecise alignment of the press-fit fastening elements that are arranged on the optical device in relation to the press-fit fastening elements that are arranged on the carrier.

It is preferred that rod-type fastening elements that are fixed on the or in the carrier are provided that are arranged both in a hole in the holding device part of the at least one semiconductor light source arrangement as well as in a hole in the base section of the at least one optical device. As a consequence, it is possible to achieve a common press fit of semiconductor light source arrangement and optical device on the carrier in a simple manner. In addition, as a result of the common press fit, the at least one semiconductor light source arrangement and the at least one optical device may be mounted on the carrier in one production step.

In accordance with various embodiments, the holes in the base section of the at least one optical device and the bore holes in the holding device part of the at least one semiconductor light source arrangement are embodied in an identical manner.

The holes of the press fits are advantageously embodied as bore holes for manufacturing reasons and said bore holes include a diameter smaller than the diameter of the section of the rod-type fastening element that is arranged in the corresponding hole, wherein the holes include at least one slot in each case on their edges. The forces that are caused as a result of the excess dimensions of the rod-type fastening element that is arranged in the bore hole are absorbed by means of the slot on the edge of the bore hole.

In the case of at least two bore holes, the slot advantageously extends from the edge of the respective bore hole to an outer edge of the holding device part of the semiconductor light source arrangement or rather to an outer edge of the base section of the optical device. As a consequence, said bore hole functions like a clamp that clamps around the rod-shaped fastening element and that renders it possible to absorb mechanical forces that by way of example are caused by means of the different thermal expansion of the holding device part of the semiconductor light source arrangement, the base section of the optical device and the carrier or as a result of an imprecise placement of the bore holes.

As a result of the press fits that are present at multiple preferably at least three locations, the tolerance of the adjustment of the at least one semiconductor light source arrangement on the carrier is very low. In addition, the common press fit of the at least one semiconductor light source arrangement and the at least one optical device on the carrier does not cause any additional tolerance that would reduce the accuracy of the adjustment of the entire system of the carrier, semiconductor light source arrangement and optical device for the at least one optical device. The carrier, the at least one semiconductor light source arrangement and the at least one optical device are always under mechanical stress as a result of the press fits and consequently it is ensured that the at least one semiconductor light source arrangement and the at least one optical device sit on the carrier in a play-free manner. In addition as a consequence, the effects of the different thermal expansion of the above mentioned parts of the illumination device in accordance with the disclosure are compensated for. In particular, the forces that occur as a result of a different thermal expansion of the carrier, the semiconductor light source arrangement and the optical device are absorbed as a result of the press fits. In addition, the press fits ensure a very good thermal coupling between the at least one optical device, the at least one semiconductor light source arrangement and the carrier so that the heat that arises at the at least one semiconductor light source and the at least one optical device during operation may be dissipated directly by way of the carrier to a cooling body. The carrier itself is advantageously embodied as a heat sink or a cooling body and is therefore preferably embodied from metal.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
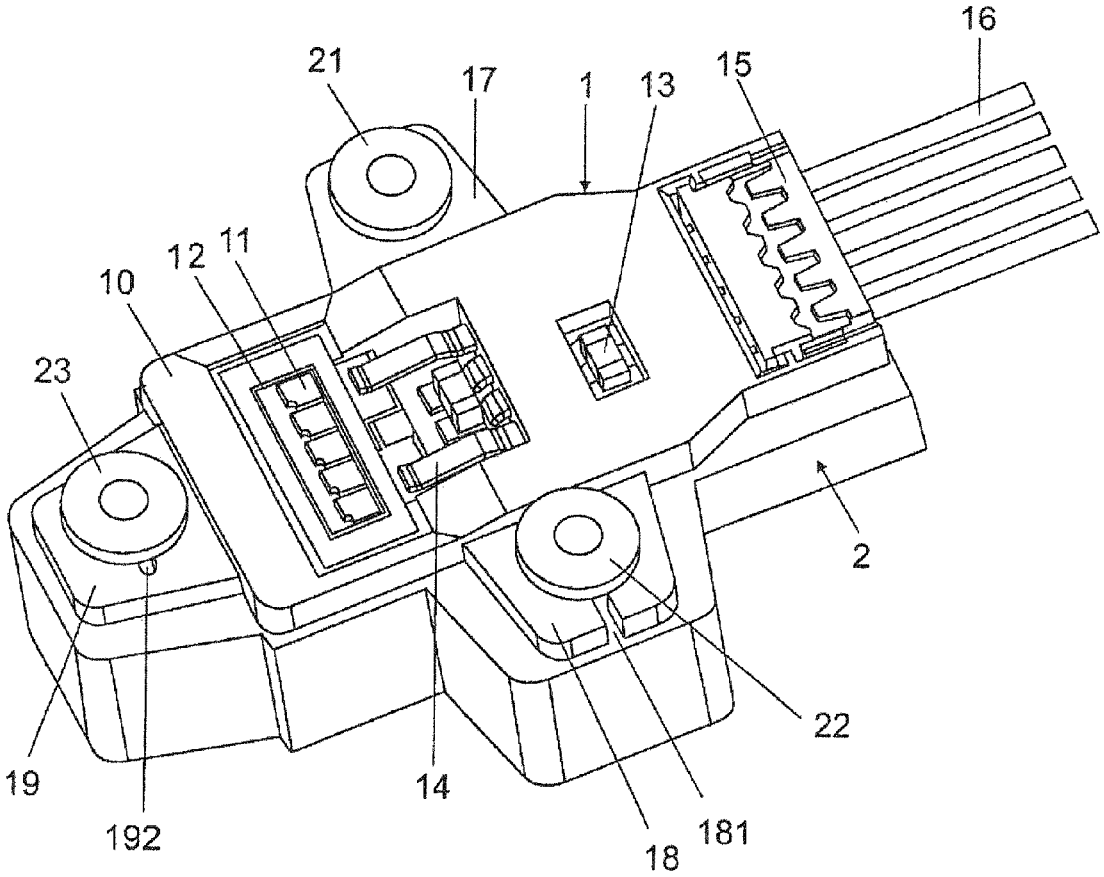
FIG. 1 illustrates a perspective view of an illumination device in accordance with the first embodiment of the disclosure.

FIG. 1 schematically illustrates an illumination device in accordance with the first embodiment of the disclosure. This illumination device includes a semiconductor light source arrangement 1 and a carrier 2 on which the semiconductor light source arrangement 1 is fixed by means of a press fit. The semiconductor light source arrangement 1 includes five light diode chips 11 that are arranged in a row on a substrate 12, and a holding device part 10 that is embodied from synthetic material and the substrate 12 having the light diode chips 11 is embedded in said holding device part by means of synthetic injection material molding technology. The substrate 12 having the light diode chips 11 is arranged in a window of the holding device part 10 so that the light emission of the light diode chips 11 is hardly impeded by means of the holding device part 10. In addition, components of an operating device 13 for operating the light diode chips 11 are housed in the holding device part 10. The semiconductor light source arrangement 1 further includes metal contact springs 14 that are used for the purpose of providing an electrical connection between the contacts of the five light diode chips 11 and the contacts of the operating device 13. Furthermore, the semiconductor light source arrangement 1 includes electrical connectors 15 that are connected to electrical connector cables 16 for the purpose of supplying energy to the light diode chips 11 and controlling said light diode chips and also their operating device 13. A connecting lug 17, 18, 19 is arranged in each case on three sides of the holding device part 10 of the semiconductor light source arrangement 1. These connecting lugs 17, 18, 19 are in each case provided with a bore hole 170, 180, 190 that in each case is used for the purpose of producing a press fit with the carrier 2. A rivet 21, 22, 23 is arranged in each bore hole 170, 180, 190 for the purpose of producing a press fit with the carrier 2, wherein the diameter of the section of the rivets 21, 22, 23 that is arranged in the respective bore hole 170, 180 or rather 190 is insignificantly larger than the diameter of the respective bore hole 170, 180 or rather 190.

Figure 4:
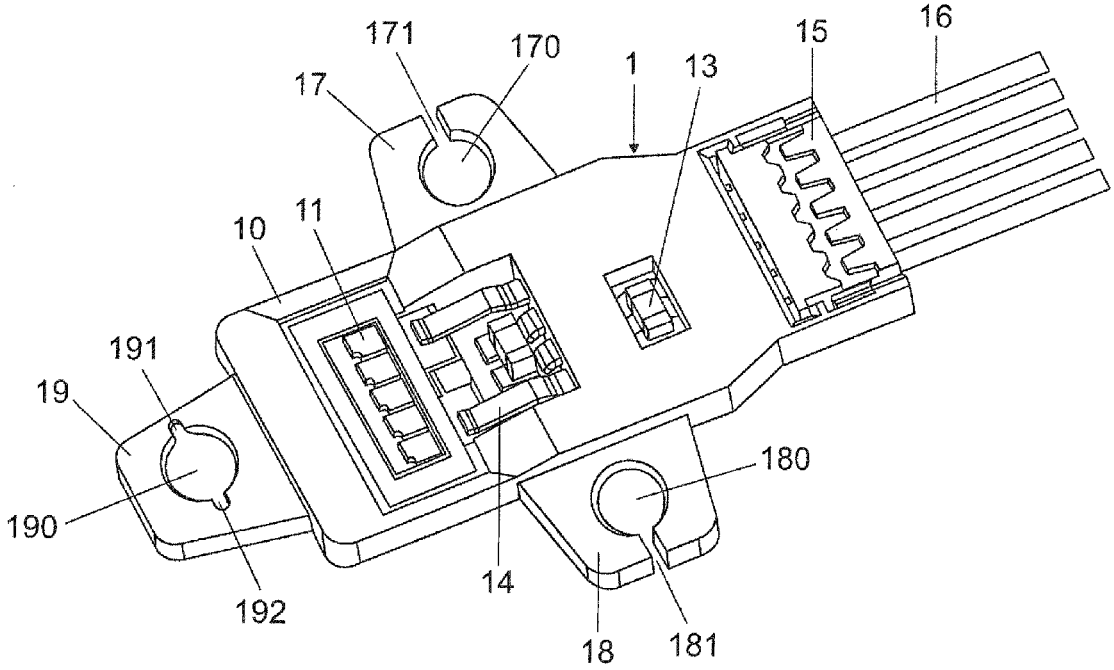
FIG. 4 illustrates a perspective view of the semiconductor light source arrangement of the illumination device in accordance with the first and second embodiment of the disclosure.

The form and arrangement of the bore holes 170, 180, 190 in the synthetic material housing 10 of the semiconductor light source arrangement 1 is illustrated in FIG. 4. The bore holes 170, 180, 190 form the corners of an imaginary triangle. Two bore holes 170, 180 that lie opposite one another are in each case provided with a slot 171, 181 that extends in each case from the edge of the corresponding bore hole 170 or rather 180 to an outer edge of the associated connecting lug 17 or rather 18. In other words, the bore hole 170, 180 extends through the slots 171, 181 to the outer edge of the connecting lug 17, 18. As a consequence, said connecting lugs 17, 18 have the effect of a clamp that clamps around the respective rivet 21 or rather 22 that includes excess dimensions in relation to the corresponding bore hole 170 or rather 180. The third bore hole 190 that is arranged in the connecting lug 19 includes two slots 191, 192 that are arranged diametrically opposite one another and in each case on the edge of the bore hole 190; however, said slots do not extend to an outer edge of the third connecting lug 19. The two diametrically opposite lying slots 191, 192 and the bore hole 190 enable the third connecting lug 19 to act like a clamp. The third connecting lug 19 fixes the third rivet 23 that includes excess dimensions in relation to the bore hole 190 in a clamp-like manner. The bore hole 190 that is provided with the slots 191, 192 and is located in the third connecting lug 19 renders it possible to precisely position the semiconductor light source arrangement 1 on the carrier 2, wherein the mechanical forces that are caused by the excess dimension of the third rivet 23 are compensated for by the two slots 191, 192. The other two clamp-type connecting lugs 17, 18 with the associated bore holes 170, 180 and the corresponding slots 171, 181 render it possible to compensate for the mechanical forces that are caused by means of different thermal expansion of the semiconductor light source arrangement 1 and the carrier 2 or as a result of an imprecise placement of the rivets 21, 22, 23 in relation to the bore holes 170, 180, 190. It is also ensured in the case of a very precise positioning of the rivets 21, 22, 23 in relation to the bore holes 170, 180, 190 and in the cold state (in the case of a room temperature of 22° C.) that the semiconductor light source arrangement 1 is fastened to the carrier 2 in a play-free manner by virtue of the press fit by means of the above mentioned bore holes.

The carrier 2 is embodied as a cooling body and is embodied from a material that has a high heat conduction capability, by way of example aluminum or copper. The rivets 21, 22, 23 are in each case arranged in a bore hole 200 of the carrier 2 with a press fit. The three bore holes 200 for the rivets 21, 22, 23 are arranged in an imaginary triangle on a planar surface of the carrier 2 and form a reference for the spatial positioning and alignment of the semiconductor light source arrangement 1.

Figure 2:
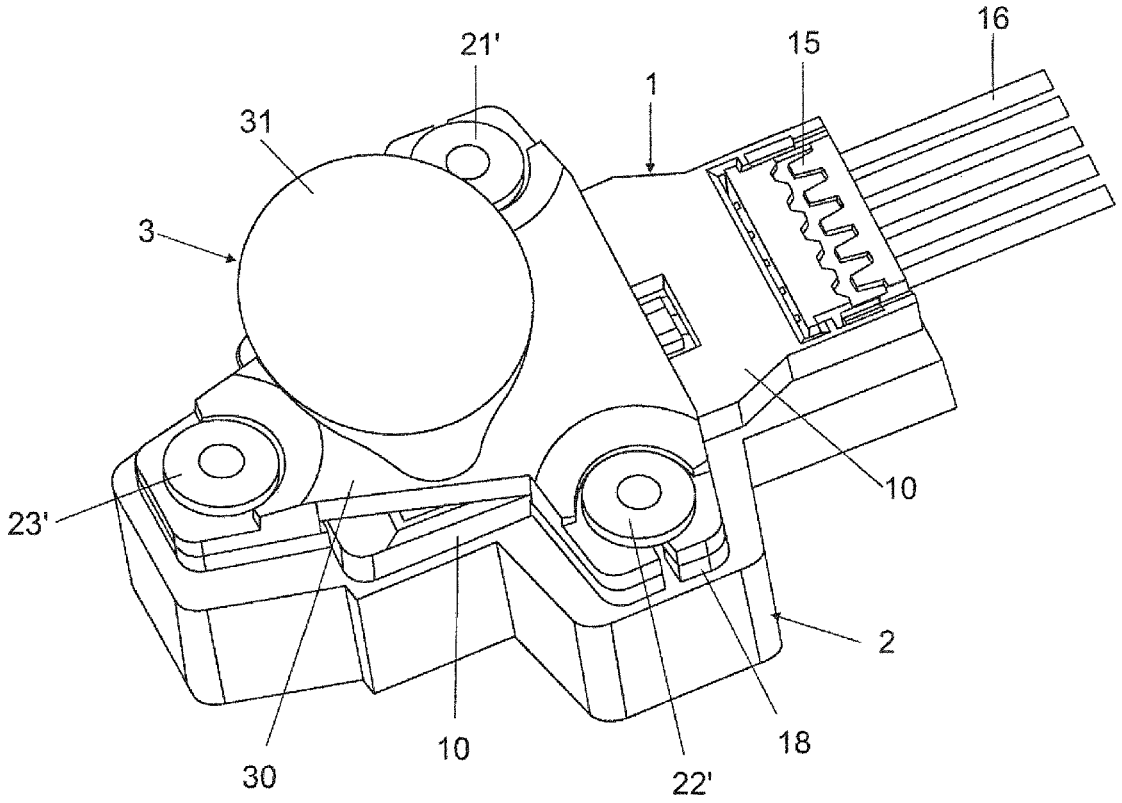
FIG. 2 illustrates a perspective view of an illumination device in accordance with the second embodiment of the disclosure.
Figure 3:
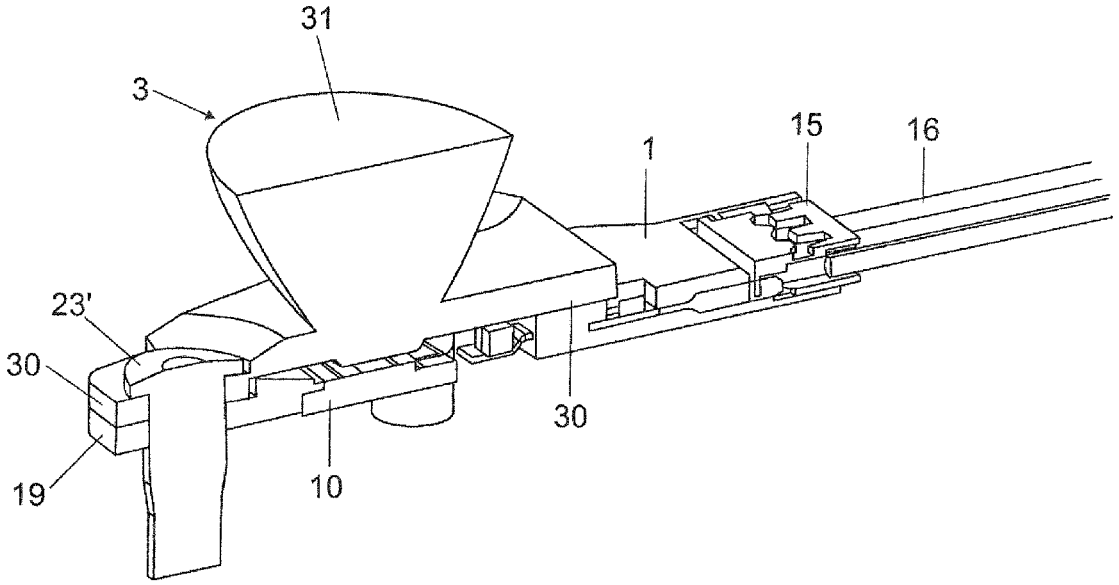
FIG. 3 illustrates a cross sectional view through the illumination device that is illustrated in FIG. 2 without carrier.

FIGS. 2 and 3 illustrate the illumination device in accordance with the second embodiment of the invention. The illumination device in accordance with the second exemplary embodiment of the invention is to a large extent identical to the illumination device in accordance with the above described first embodiment of the invention. The second embodiment differs from the illumination device in accordance with the above described first embodiment of the invention only by virtue of the fact that the illumination device in accordance with the second embodiment of the invention includes a further optical device 3 in addition to the semiconductor light source arrangement 1 and the carrier 2, and said optical device is arranged downstream of the semiconductor light source 1. In particular, the semiconductor light source arrangement 1 and the carrier 2 are embodied in an identical manner in the case of both embodiments of the invention. Therefore, for the description of the semiconductor light source arrangement 1 and the carrier 2 in accordance with the second exemplary embodiment of the invention, reference is made to the corresponding description of the semiconductor light source arrangement 1 and the carrier 2 in accordance with the first embodiment of the invention. The optical device 3 is embodied from transparent synthetic material and includes a truncated cone-shaped section 31 and also a flat base section 30. The carrier 2, the semiconductor light source arrangement 1 and the optical device 3 are arranged one on top of the other in a sandwich like manner, wherein the semiconductor light source arrangement 1 is arranged between the carrier 2 and the optical device 3 in such a manner that the light that is emitted by the light diode chips 11 is coupled into the truncated cone-type section 31 of the optical device 3. The base section 30 of the optical device 3 is provided with three bore holes 32, 33, 34 that correspond to the bore holes 170, 180, 190 in the synthetic material housing 10 of the semiconductor light source arrangement 1. The bore holes 32, 33, 34 in the base section 30 of the optical device 3 include the same form and alignment as the bore holes 170, 180, 190 in the synthetic material housing of the semiconductor light source arrangement 1. In particular, the bore holes 32, 33, 34 in the base section 30 of the optical device 3 are equipped with identically embodied slots 321, 331, 341 and 342 as the bore holes 170, 180, 190 in the synthetic material housing 10 of the semiconductor light source arrangement 1.

As a consequence, the rivets 21', 22', 23' in the case of the illumination device in accordance with the second embodiment of the invention are arranged in each case with a press fit both in a bore hole 170, 180 or rather 190 of the holding device part 10 of the semiconductor light source arrangement 1 as well as in a bore hole 32, 33 or rather 34 in the base section 30 of the optical device 3. The diameter of the section of the rivets 21', 22', 23' that is inserted into the bore holes 170, 180 or rather 190 of the semiconductor light source arrangement 1 and in the bore holes 32, 33 or rather 34 of the optical device 3 is larger than the diameter of these bore holes 170, 180, 190, 32, 33 or rather 34. In this manner, a common press fit of the semiconductor light source arrangement 1 and the optical device 3 is achieved on the carrier 2. The rivets 21', 22', 23' are in each case arranged in a bore hole 200 of the carrier 2 with a press fit. The three bore holes 200 for the rivets 21', 22' and 23' are arranged in an imaginary triangle on a planar surface of the carrier 2 and form a reference point for the spatial positioning and alignment of the semiconductor light source arrangement 1 and the optical device 3.

Figure 5:
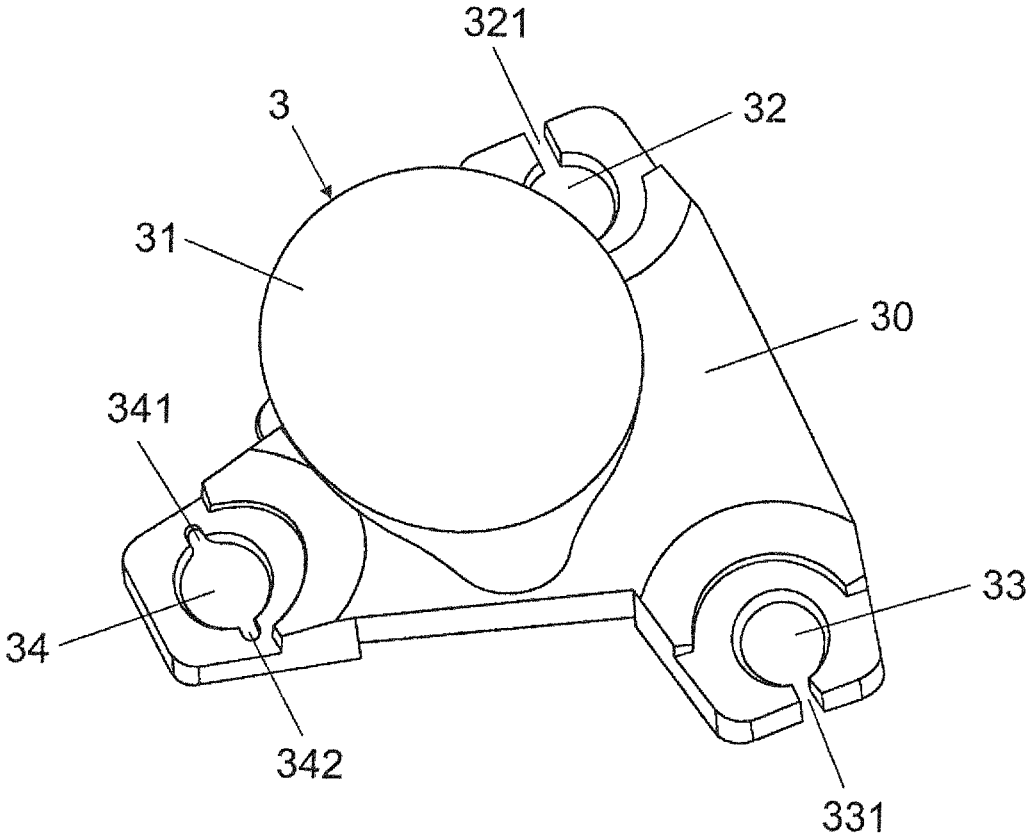
FIG. 5 illustrates a perspective view of the optical device of the illumination device in accordance with the second embodiment of the disclosure.

Details of the optical device 3, in particular the form and arrangement of the bore holes 32, 33, 34 are schematically illustrated in FIG. 5.

The bore holes 32, 33, 34 form the corners of an imaginary triangle. Two bore holes 32, 33 that lie opposite one another are in each case provided with a slot 321, 331 that in each case extends from the edge of the corresponding bore hole 32 or rather 33 to an outer edge of the base section 30 of the optical device 3. In other words, as a result of the slots 321, 331, the bore hole 32, 33 extends as far as the outer edge of the base section 30 of the optical device 3. As a consequence, said regions of the base section 30 that are provided with the bore holes and slots have the effect of a clamp that clamps around the respective rivet 21' or rather 22' that includes excess dimensions in relation to the corresponding bore hole 31 or rather 32. The third bore hole 34 that is arranged in the base section 30 of the optical device 3 includes two slots 341, 342 that lie diametrically opposite one another and are arranged in each case on the edge of the bore hole 34 however, said slots do not extend as far as an outer edge of the base section 30. The two diametrically opposite lying slots 341, 342 and the bore hole 34 enable this region of the base section 30 of the optical device 3 to have the effect of a clamp for fixing the rivet 23' is over-dimensioned with respect to the bore hole 34, said region being provided with the third bore hole and the two slots. The bore hole 34 that is provided with the slots 341, 342 and is located in the base section 30 of the optical device 3 renders it possible to position the optical device 3 precisely on the carrier 2, wherein the mechanical forces that are caused by the excess dimensions of the third rivet 23' and exerted on the optical device 3 are compensated for by the two slots 341, 342. The other two bore holes 32, 33 and the corresponding slots 321, 331 render it possible to compensate for mechanical forces that are caused as a result of a different thermal expansion of the optical device 3, the semiconductor light source arrangement 1 and the carrier 2 or as a result of an imprecise placement of the rivets 21', 22', 23' in relation to the bore holes 32, 33, 34. It is also ensured in the case of a very precise positioning of the rivets 21', 22', 23' in relation to the bore holes 32, 33, 34 and in the cold state (in the case of a room temperature of 22° C.) that the optical device 3 is fastened to the carrier 2 in a play-free manner by virtue of the press fit by means of the above mentioned bore holes and rivets.

Figure 6:
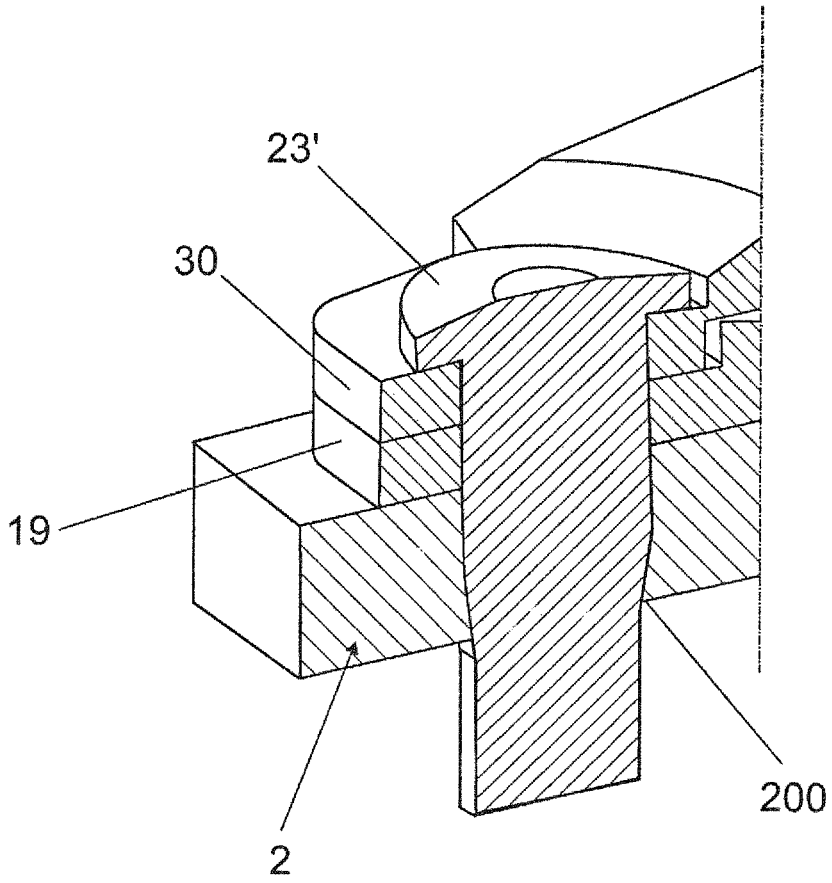
FIG. 6 illustrates a cross sectional view through the press fit that is illustrated in FIG. 3 including the carrier.

The bore holes 32, 33, 34 and the slots 321, 331, 341, 342 in the base section 30 of the optical device 3 are placed precisely over the bore holes 170, 180, 190 and the slots 171, 181, 191, 192 and the rivets 21', 22', 23' are inserted in each case with a press fit both in a bore hole 32, 33 or rather 34 in the base section 30 of the optical device 3 as well as in a bore hole 170, 180 or rather 190 in the synthetic material housing 10 of the semiconductor light source arrangement 1. As a consequence, a common press fit of the optical device 3 and the semiconductor light source arrangement 1 on the carrier 2 is achieved. The rivets 21, 22, 23 or rather 21', 22' 23' are embodied in both embodiments from metal, by way of example from copper or aluminum. The excess dimensions of the rivets 21, 22, 23 or rather 21', 22', 23' in relation to the bore holes 170, 180, 190 or rather 32, 33, 34 in the semiconductor light source arrangement 1 or rather in the optical device 3 lie in the range of 0.02 mm to 0.06 mm. In other words the diameter of the section of the rivets that is inserted into the above mentioned bore holes is about 0.02 mm to 0.06 mm larger than the diameter of the above mentioned bore holes. The rivets 21, 22, 23 or rather 21', 22', 23' are tapered at one end in order to render it possible to insert them more easily into the bore holes. FIG. 6 schematically illustrates this situation with reference to the rivet 23'.

The invention is not limited to the above further described embodiments of the invention. By way of example, the semiconductor light source arrangement 1 includes not just light diode chips 11 rather also other user-defined semiconductor light sources such as for example user defined types of light diodes and laser diodes that where necessary with the aid of luminescent substances emit white or colored light during their operation, and also organic light diodes (OLED). In addition, multiple semiconductor light source arrangements may be mounted on the carrier 2. In addition, the optical device 3 includes other user-defined embodiment forms, such as for example optical lenses, optical devices having total reflection (TIR-optical devices), light conductors and also reflectors. Accordingly, the optical device 3 may be embodied from a transparent material, such as by way of example glass, sapphire and synthetic material or, in the case of a reflector, said optical device may be embodied from a metal or from a dichroitic material. Furthermore, the optical device may include luminescent material on a light entry surface or light exit surface or on a light reflecting surface and said luminescent material performs a wave length conversion of the light. The optical device 3 may be arranged downstream of one or multiple semiconductor light source arrangements 1. In addition, it is not absolutely necessary for the carrier 2 to be embodied from copper or aluminum, rather said carrier may also be embodied from another metal with good heat conducting characteristics or from a ceramic with good heat conducting capability such as by way of example aluminum oxide or aluminum nitride ceramic.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. An illumination device comprising at least one semiconductor light source arrangement that is fixed to a carrier, wherein the at least one semiconductor light source arrangement is fixed to the carrier at at least three locations by means of a press fit; said press fits being formed by holes in a holding device part of the semiconductor light source arrangement and by rod-type fastening elements that are arranged in the holes and are fixed in the carrier or on the carrier, wherein the press fits at at least two of the three locations are embodied as clamp-type holding devices, said clamp-type holding devices in each case are formed by a bore hole in the holding device part, wherein the bore hole comprises at least one slot on its edge, and wherein the at least one slot extends from the edge of the respective bore hole as far as an outer edge of the holding device part of the at least one semiconductor light arrangement;

wherein the clamp-type holding devices at at least two of the three locations are positioned closer in proximity to the at least one semiconductor light arrangement than the press fit at at least one of the three locations.

2. The illumination device as claimed in claim 1, wherein the holding device part is embodied from synthetic material.

3. The illumination device as claimed in claim 1, wherein the illumination device comprises at least one optical device that is arranged downstream of the at least one semiconductor light source arrangement and wherein the at least one optical device and the at least one semiconductor light source arrangement are fixed to the carrier by means of a common press fit.

4. The illumination device as claimed in claim 3, wherein the at least one optical device comprises a base section that is provided with holes for the press fit, wherein at least some of the holes in the base section of the at least one optical device correspond to holes in the holding device part of the at least one semiconductor light source arrangement.

5. The illumination device as claimed in claim 4, wherein the base section of the at least one optical device comprises at least two clamp-type holding device elements that are formed in each case by a hole that extends as far as an outer edge of the base section of the optical device.

6. The illumination device as claimed in claim 4, wherein the press fit is formed by a rod-type fastening element that is fixed in the carrier or on the carrier and is arranged both in a hole in the holding device part of the at least one semiconductor light source arrangement as well as in a hole in the base section of the at least one optical device.

7. The illumination device as claimed in claim 4, wherein the holes in the base section of the at least one optical device and the holes in the holding device part of the at least one semiconductor light source arrangement are embodied in an identical manner.

8. The illumination device as claimed in claim 1, wherein the rod-type fastening elements are elements from the group of pins, rivets and screws.

9. The illumination device as claimed in claim 8, wherein the rod-type fastening elements are arranged in each case in a bore hole of the carrier.

* * * * *